US006702990B1

(12) United States Patent
Camacho et al.

(10) Patent No.: US 6,702,990 B1
(45) Date of Patent: Mar. 9, 2004

(54) SPOT PICKER

(75) Inventors: Joseph Camacho, San Francisco, CA (US); Richard Flanagan, Berkeley, CA (US)

(73) Assignee: The Gel Company, San Francisco ( * ) Notice: Subject to any disclaimer, the term of this patent is extended or adjusted under 35 U.S.C. 154(b) by 59 days.

(21) Appl. No.: 10/068,496

(22) Filed: Feb. 5, 2002

(51) Int. Cl.[7] ..... B01L 3/02

(52) U.S. Cl. ..... 422/100; 73/864.01; 73/864.13; 83/167; 83/919; 204/613; 422/99; 422/101

(58) Field of Search ..... 422/99, 100, 101; 83/167, 919; 73/864.13, 864.16, 864.18, 864.41, 864.01; 204/613

(56) References Cited

U.S. PATENT DOCUMENTS 3,815,790 A * 6/1974 Allen et al. ..... 73/864.13
4,418,580 A * 12/1983 Satchell et al. ..... 73/864.13
5,210,927 A * 5/1993 Lamont et al. ..... 29/564.2
5,217,591 A * 6/1993 Gombocz et al. ..... 204/466
5,496,523 A 3/1996 Gazit et al.
6,117,394 A 9/2000 Smith
6,342,143 B1 * 1/2002 Minden ..... 204/462
6,565,728 B1 * 5/2003 Kozulic ..... 204/606

* cited by examiner

*Primary Examiner*—Jan Ludlow
(74) *Attorney, Agent, or Firm*—Jack Lo

(57) ABSTRACT

A spot picker is comprised of a pipette and a disposable cutting tip. The pipette is comprised of a housing with a suction tube projecting from a lower end. An actuation button is positioned at the top end of the housing. The actuation button is connected to a piston inside the suction tube. A plunger attached to the piston has a lower end positioned outside the suction tube. The cutting tip is comprised of a hollow tube with an open proximal end attached to the suction tube. A compressible porous hydrophobic filter is securely but movably positioned within the hollow tube. The cutting tip cuts a gel spot when its open lower end is pushed into a sheet of gel. The plunger pushes the filter outward to discharge the gel spot from the cutting tip when the actuation button is fully depressed.

3 Claims, 3 Drawing Sheets

SPOT PICKER

BACKGROUND OF THE INVENTION

1. Field of the Invention

This invention relates generally to pipettes and pipette tips.

2. Prior Art

An air pipette is a laboratory tool for transferring small but precise quantities of fluids between containers. A typical pipette shown in FIG. 1 is comprised of a hand-held housing 10 with a suction tube 11 attached to a lower end. An actuation button 12 and a tip eject button 13 are positioned at the top of housing 10. Actuation button 12 is connected to a piston 14 inside tube 11, and is biased by a spring to the uppermost or retracted position shown. Tip eject button 13 is connected to an ejection arm 15 positioned around the lower end of suction tube 11. A disposable tubular pipette tip 16 is attached to suction tube 11 by fitting an open proximal end of pipette tip 16 around the lower end of suction tube 11. A porous hydrophobic filter 17 is positioned within pipette tip 16. Typical filters are disclosed in U.S. Pat. No. 6,117,394 to Smith, U.S. Pat. No. 6,045,757 to Moriarty et al., and U.S. Pat. No. 5,496,523 to Gazit et al. Such filters are made of incompressible materials and immovably fixed inside their pipette tips.

To transfer a fluid from one container to another, actuation button 12 is depressed to a first stop to move piston 14 downward inside suction tube 11. Pipette tip 16 is dipped into the fluid, and actuation button 12 is released and allowed to retract. When piston 14 is moved upward, a low pressure within pipette tip 16 is generated to draw in the fluid. Filter 17 has pores which allow air to pass through for sucking in the fluid, but which are fine enough to prevent the fluid from passing through at the working pressure of the pipette. Therefore, filter 17 prevents the fluid from contaminating suction tube 11.

After the fluid is drawn in, pipette tip 16 is positioned over another container, and actuation button 12 is depressed to move piston 14 past the first stop to a second stop and discharge the fluid. Tip eject button 13 is depressed to push the used pipette tip 16 off suction tube 11 with ejection arm 15. A clean pipette tip is attached to suction tube 11 for transferring another fluid to avoid contaminating the second fluid with the first fluid.

Sometimes semi-solids, such as gels, are also transferred in laboratory work. Although a conventional pipette can cut a gel spot by pressing the tip into a gel sheet, the gel spot tends to get sucked up fairly high in the tip. When the piston is depressed, the gel spot is moved downward unevenly and break the air seal between the gel spot and the tip before the gel spot is ejected.

BRIEF SUMMARY OF THE INVENTION

The objects of the present spot picker are:

- to provide a pipette with a disposable cutting tip for cutting a spot from a semi-solid material;
- to protect the pipette from being contaminated by the material; and
- to reliably eject the spot from the cutting tip.

The present spot picker is comprised of a pipette and a disposable cutting tip. The pipette is comprised of a housing with a suction tube projecting from a lower end. An actuation button is positioned at the top end of the housing. The actuation button is connected to a piston inside the suction tube. A plunger attached to the piston has a lower end positioned outside the suction tube. The cutting tip is comprised of a hollow tube with an open proximal end attached to the suction tube. A compressible porous hydrophobic filter is securely but movably positioned within the hollow tube. The cutting tip cuts a gel spot when its open lower end is pushed into a sheet of gel. The plunger pushes the filter outward to discharge the gel spot from the cutting tip when the actuation button is fully depressed.

DRAWING REFERENCE NUMERALS

| | | | |
|---|---|---|---|
| 12. | Actuation Button | 13. | Tip Eject Button |
| 14. | Piston | 15. | Ejection Arm |
| 16. | Pipette Tip | 17. | Filter |
| 20. | Pipette | 21. | Cutting Tip |
| 22. | Housing | 23. | Suction Tube |
| 24. | Actuation Button | 25. | Tip Eject Button |
| 26. | Piston | 27. | Plunger |
| 28. | Ejection Arm | 29. | Barrier |
| 30. | Gel Sheet | 31. | Gel Spot |
| 32. | Area | | |

DETAILED DESCRIPTION OF THE INVENTION

Figure 1:
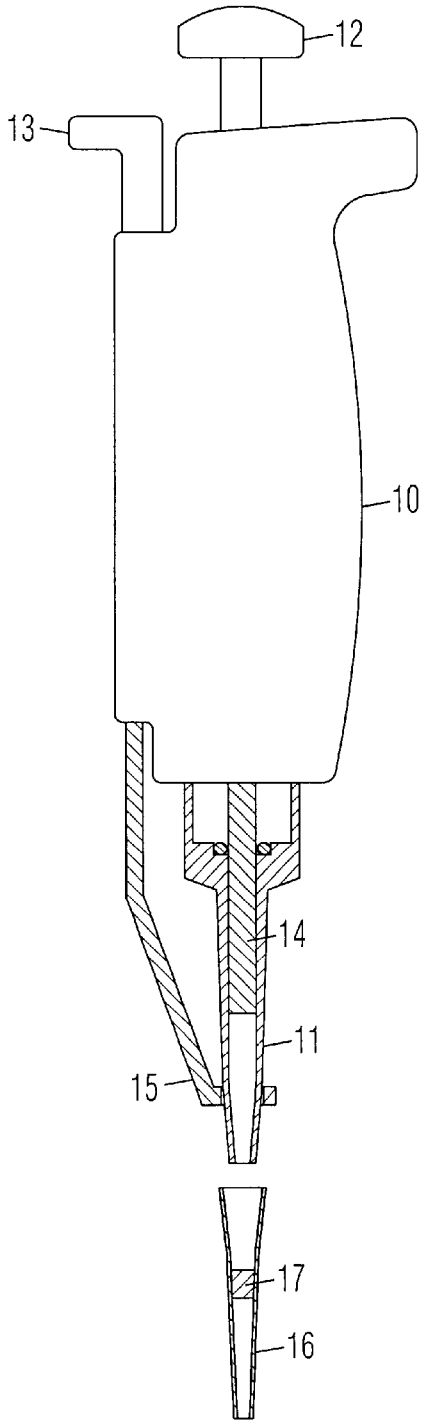
Fig. 1 Prior Art
FIG. 1 is a partial sectional side view of a prior art pipette and filtered pipette tip.
Figure 2:
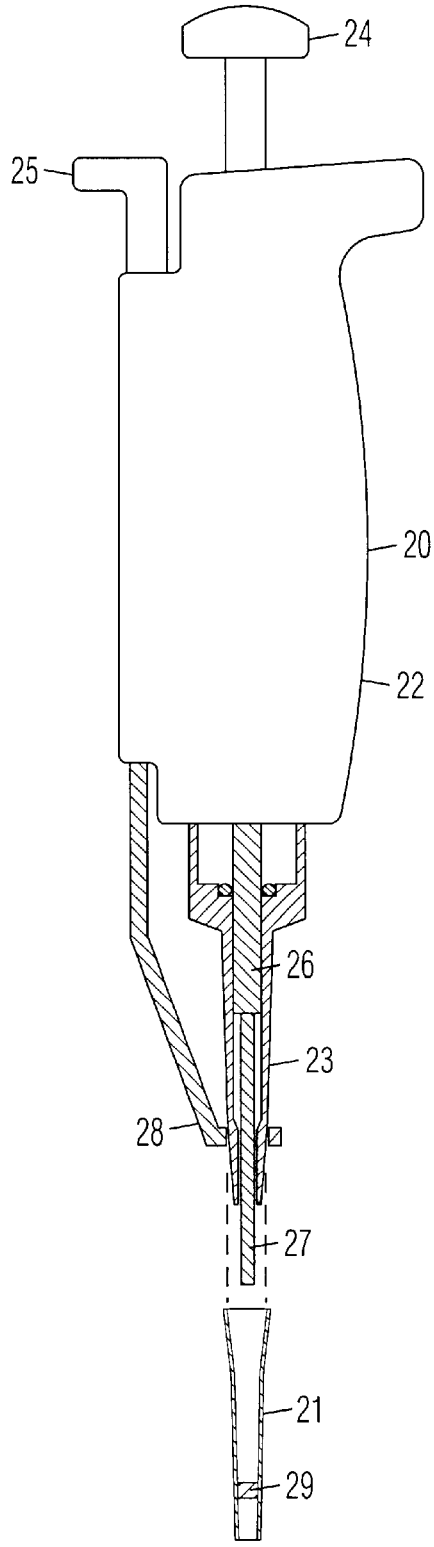
FIG. 2 is a partial sectional side view of the present spot picker before assembly.

FIG. 2:

A preferred embodiment of a spot picker is shown in a partial sectional side view in FIG. 2. It is comprised of a pipette 20 and a disposable cutting tip 21. Pipette 20 is comprised of a housing 22 with an open ended suction tube 23 projecting from a lower end. In this example, suction tube 23 is attached to a hand-held housing, but it may be attached to a robotic arm instead. An actuation button 24 and a tip eject button 25 are arranged on housing 22. Actuation button 24 is connected to a piston 26 inside suction tube 23. The connection between actuation button 24 and piston 26 is well known in the art. The upper end of an elongated plunger 27 is attached to the lower end of piston 26, and the lower end of plunger 27 is positioned outside suction tube 23. In FIG. 2, plunger 27 and actuation button 24 are biased by a spring (not shown) inside housing 22 to the uppermost or retracted position. Tip eject button 25 is connected to an ejection arm 28 positioned around suction tube 23 above its lower end. The connection between tip eject button 25 and ejection arm 28 is also well known in the art. Tip eject button 25 and ejection arm 28 are also biased by a spring (not shown) inside housing 22 to the uppermost or retracted position.

Disposable cutting tip 21 is comprised of a tube with open opposite ends. Cutting tip 21 is arranged to be detachably connected to suction tube 23 by snugly fitting the upper end of cutting tip 21 around the lower end of suction tube 23. A compressible, porous hydrophobic barrier 29 is securely but movably positioned within cutting tip 21 and spaced upwardly from its lower end. Barrier 29 is preferably slightly wider than cutting tip 21, so that it is slightly compressed when fitted inside for staying in position, but is still free to slide along cutting tip 21 when pushed. Barrier 29 is preferably comprised of a polyethylene barrier, but it may be comprised of another suitable material. Cutting tip 21 may also be attached to the suction tube of a material handling robot instead of a hand-held pipette.

Figure 3:
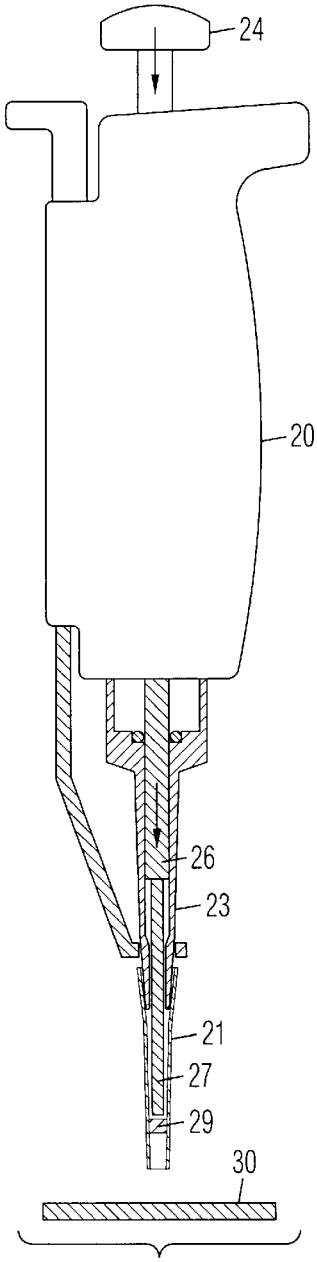
FIG. 3 is a partial sectional side view thereof about to be inserted into a sheet of gel.

FIG. 3:

Cutting tip 21 is shown attached to pipette 20 in FIG. 3 for transferring a portion of a gel sheet 30 to another area. As shown by the arrows, actuation button 24 is depressed to a first stop to position plunger 27 slightly above or in light contact with barrier 29. Cutting tip 21 is positioned over gel sheet 30.

Figure 4:
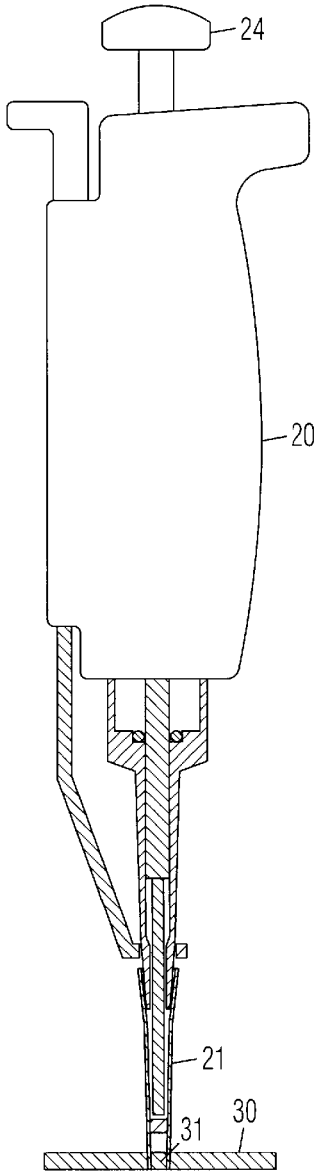
FIG. 4 is a partial sectional side view thereof inserted into the sheet of gel.

FIG. 4:

Cutting tip 21 is shown inserted into gel sheet 30 in FIG. 4. A gel spot 31 is cut in gel sheet 30 by the open lower end of cutting tip 21 when it is pushed into gel sheet 30.

Figure 5:
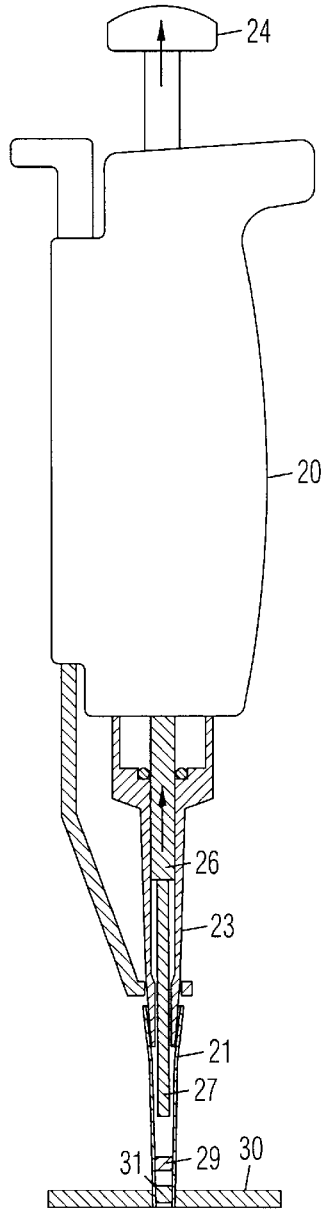
FIG. 5 is a partial sectional side view thereof drawing the gel into the cutting tip.

FIG. 5:

Actuation button 24 is shown released in FIG. 5 to retract piston 26 and plunger 27, as shown by the arrows. Since barrier 29 is porous, the suction generated by the retraction of piston 26 and plunger 27 above filter 29 is transmitted to gel spot 31, which is slightly sucked into cutting tip 21 and fully released from gel sheet 30. Since barrier 29 is also hydrophobic, material from gel spot 31 cannot pass through barrier 29 and is prevented from reaching plunger 27. Therefore, plunger 27 is protected from contamination by cutting tip 21.

Figure 6:
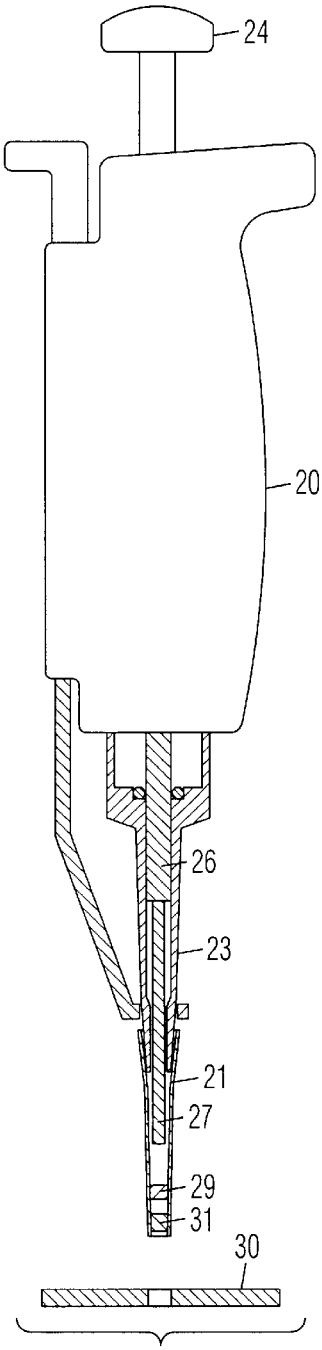
FIG. 6 is a partial sectional side view thereof lifting the gel spot from the sheet of gel.

FIG. 6:

In FIG. 6, pipette 20 and cutting tip 21 are shown lifted from gel sheet 30 to remove gel spot 31.

Figure 7:
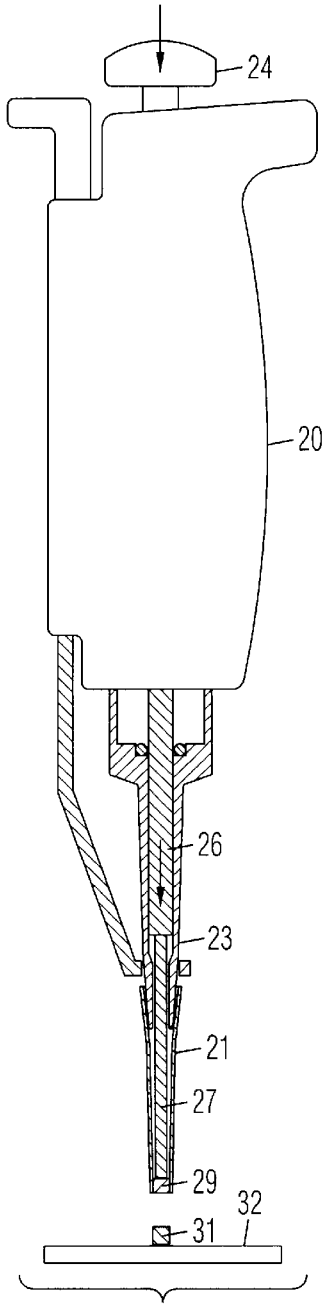
FIG. 7 is a partial sectional side view thereof ejecting the gel spot from the cutting tip.

FIG. 7:

Pipette 20 is positioned over an area 32 away from the gel sheet for receiving gel spot 31, as shown in FIG. 7. Actuation button 24 is depressed past the first stop to a second stop to push barrier 29 downward with plunger 27 until gel spot 31 is pushed out of cutting tip 21 by barrier 29, as shown by the arrow. Barrier 29 stays inside cutting tip 21 after gel spot 31 is ejected. Actuation button 24 is released and allowed to return its uppermost or retracted position.

Figure 8:
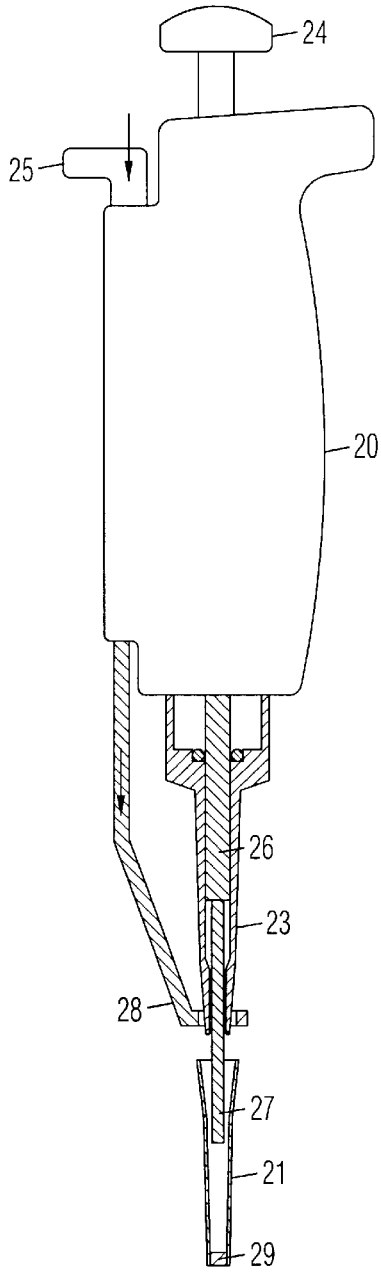
FIG. 8 is a partial sectional side view thereof ejecting the used cutting tip from the pipette.

FIG. 8:

After use, cutting tip 21 is ejected and discarded by depressing tip eject button 25 to advance ejection arm 28 against cutting tip 21, as shown in FIG. 8. Cutting tip 21 is arranged to require a greater force to dislodge from suction tube 23 than is required to push barrier 29 and the gel spot through cutting tip 21, so that cutting tip 21 cannot be dislodged when actuation button 24 is depressed.

In addition to gels, the present spot picker can be used for cutting spots from any other semi-solid materials in addition to gels.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A cutting tip for attaching to a suction tube and for cutting a spot from a sheet of semi-solid material, said cutting tip comprising:

a hollow tube with open opposite ends, wherein an upper end thereof is arranged for attaching to a lower end of said suction tube, and a lower end thereof is arranged for cutting said spot from said sheet of semi-solid material; and a compressible barrier movably positioned within said hollow tube, wherein a lower section of said hollow tube between an initial position of said barrier and said lower end of said hollow tube is of generally constant diameter, said barrier is compressed within said hollow tube for being moved when pushed upon and for staying in position when released, said barrier is arranged for being positioned between said spot and a plunger extending from said suction tube for preventing said spot from contaminating said plunger, said barrier is arranged for being pushed downward by said plunger to a position flush with said lower end of said hollow tube for pushing said spot out of said hollow tube.

2. A spot picker, comprising:

a pipette comprising:

a suction tube with an open lower end;

a piston positioned within said suction tube and movable linearly therein for generating suction; and a plunger with an upper end attached to a lower end of said piston, wherein a lower end of said plunger is movable to a position outside said suction tube;

a cutting tip comprising:

a hollow tube with open opposite ends, wherein an upper end thereof is detachably connected to said lower end of said suction tube of said pipette, and a lower end thereof is arranged for cutting a spot from a sheet of semi-solid material; and a compressible barrier movably positioned within said hollow tube, a lower section of said hollow tube between an initial position of said barrier and said lower end of said hollow tube is of generally constant diameter, wherein said barrier is compressed within said hollow tube for being moved when pushed upon and for staying in position when released, said barrier includes a generally flat upper end which is pushed by said plunger when said plunger is depressed, and immediately disengaged from said plunger when said plunger is retracted;

wherein when said lower end of said plunger is moved to said position outside said suction tube, said lower end of said plunger is positioned within said hollow tube of said cutting tip and said barrier is pushed downward by said plunger, said plunger has a predetermined length to push said barrier to a position flush with said lower end of said hollow tube for pushing said spot out of said hollow tube, and for preventing said spot from contaminating said plunger.

3. The spot picker of claim 2, further including a housing attached to a top end of said suction tube, and an actuation button attached to said housing, wherein said actuation button is connected to a top end of said piston for simultaneous movement.

* * * * *